US005617127A

United States Patent [19]

Takeuchi et al.

[11] Patent Number: 5,617,127

[45] **Date of Patent: *Apr. 1, 1997**

[54] ACTUATOR HAVING CERAMIC SUBSTRATE WITH SLIT(S) AND INK JET PRINT HEAD USING THE ACTUATOR

[75] Inventors: Yukihisa Takeuchi, Aichi-ken; Hideo Masumori, Anjo; Nobuo Takahashi, Owariasahi, all of Japan

[73] Assignees: NGK Insulators, Ltd.; Seiko Epson Corporation, both of Japan

[ * ] Notice: The term of this patent shall not extend beyond the expiration date of Pat. No. 5,376,856.

[21] Appl. No.: 159,922

[22] Filed: Dec. 1, 1993

[30] Foreign Application Priority Data

Dec. 4, 1992 [JP] Japan ..... 4-350873
Nov. 18, 1993 [JP] Japan ..... 5-289257

[51] Int. Cl.[6] ..... B41J 2/045

[52] U.S. Cl. ..... 347/71; 310/328; 310/330

[58] Field of Search ..... 347/68, 70, 71, 347/94, 40; 310/328, 330, 331, 332, 363–366

[56] References Cited

U.S. PATENT DOCUMENTS

| | | | |
|---|---|---|---|
| 3,509,387 | 4/1970 | Thorn et al. | 310/328 |
| 3,747,120 | 7/1973 | Stemme | 347/40 X |
| 3,946,398 | 3/1976 | Kyser et al. | 347/70 |
| 4,456,850 | 6/1984 | Inoue et al. | 310/328 X |
| 4,680,595 | 7/1987 | Cruz-Uribe et al. | 347/71 |
| 4,769,570 | 9/1988 | Yokoyama et al. | 310/332 |
| 4,783,821 | 11/1988 | Muller et al. | 310/324 X |
| 4,819,014 | 4/1989 | Yasuhara et al. | 347/68 |
| 4,906,840 | 3/1990 | Zdeblick et al. | 310/328 X |
| 5,359,354 | 10/1994 | Hiraishi et al. | 347/94 X |
| 5,376,856 | 12/1994 | Takeuchi et al. | 310/328 |
| 5,402,926 | 4/1995 | Takeuchi et al. | 228/174 |

FOREIGN PATENT DOCUMENTS

| | | | |
|---|---|---|---|
| 0372521 | 6/1990 | European Pat. Off. | B41J 2/14 |
| 0572230 | 12/1993 | European Pat. Off. | B41J 2/14 |
| 56-00172 | 1/1981 | Japan | 347/40 |
| 58-196069 | 11/1983 | Japan . | |
| 59-32182 | 2/1984 | Japan . | |
| 61-253873 | 11/1986 | Japan . | |
| 63-285983 | 11/1988 | Japan . | |
| 1-282878 | 11/1989 | Japan . | |
| 2161647 | 1/1986 | United Kingdom . | |

OTHER PUBLICATIONS

Patent Abstracts of Japan, vol. 7, No. 215 (M–244) (1360) Sep. 22, 1983 & JP–A–58 108 164 (Epuson K.K.) Jun. 28, 1983.

Patent Abstracts of Japan, vol. 11, No. 356 (M–644) Nov. 20, 1987 & JP–A–62 135 377 (NEC Corp.) Jun. 18, 1987.

*Primary Examiner*—Benjamin R. Fuller
*Assistant Examiner*—Charlene Dickens
*Attorney, Agent, or Firm*—Parkhurst, Wendel & Burr, L.L.P.

[57] ABSTRACT

An actuator including a ceramic substrate and at least one piezeoelectric/electrostrictive element formed on the substrate is disclosed. The ceramic substrate includes a spacer plate having at least one window which provides at least one pressure chamber, each window being substantially closed by a closure plate and a connecting plate. The spacer plate, closure plate and connecting plate are formed from respective ceramic green sheets which are laminated on each other and fired into an integral ceramic structure as the ceramic substrate. The connecting plate has at least one slit which corresponds to each pressure chamber. Each piezoelectric/electrostrictive element is disposed on a portion of the closure plate defining the corresponding pressure chamber, so as to change a pressure of the corresponding pressure chamber. Also disposed is an ink jet print head using the actuator as described above.

15 Claims, 9 Drawing Sheets

FIG. 7a
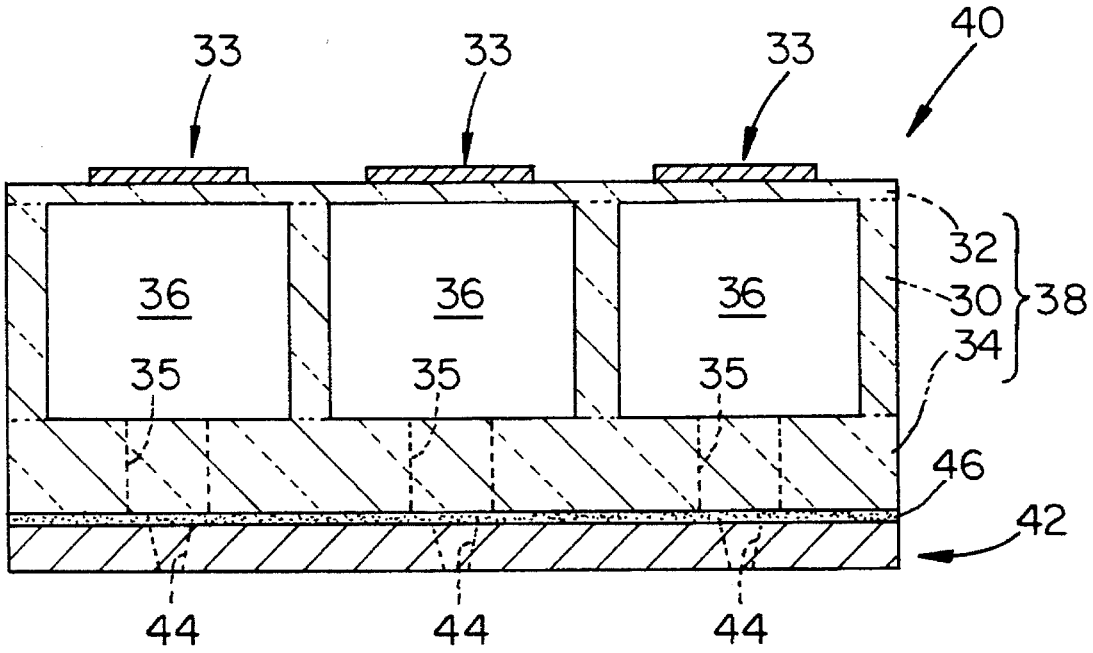
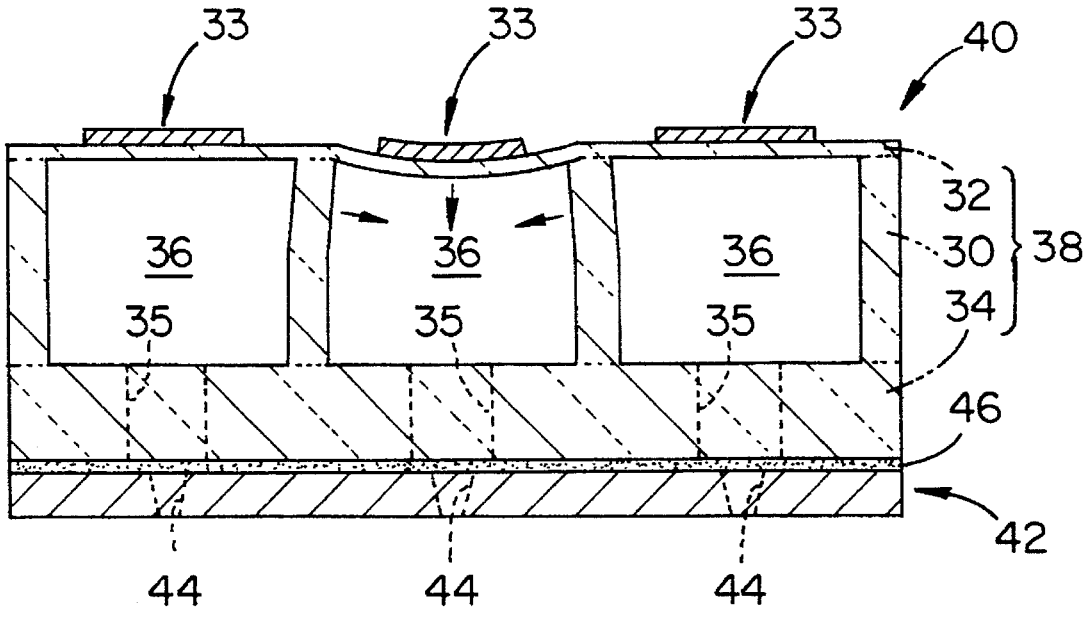
FIG. 7b

ACTUATOR HAVING CERAMIC SUBSTRATE WITH SLIT(S) AND INK JET PRINT HEAD USING THE ACTUATOR

BACKGROUND OF THE INVENTION

1. Field of the Invention

The present invention relates in general to an actuator and an ink jet print head including the actuator, and more particularly to an actuator which exhibits improved operating characteristics with high stability, and an ink jet print head using such an actuator as an ink pump for discharging an ink material from the print head.

2. Discussion of the Related Art

As a means for raising a pressure in a pressure chamber formed within a substrate of an actuator, there is recently known a piezoelectric/electrostrictive element formed on a wall defining the pressure chamber, for changing a volume of the pressure chamber due to displacement of the piezoelectric/electrostrictive element. Such an actuator may be used as an ink pump or the like of a print head used in an ink jet printer, for example. The actuator used as the ink pump is adapted to raise a pressure in the pressure chamber which is filled with an ink material, utilizing the displacement of the piezoelectric/electrostrictive element, so that fine ink particles are jetted or discharged through a nozzle that communicates with the pressure chamber, so as to effect printing by the print head.

Referring to FIGS. 4 and 5 showing a known example of the ink jet print head as described above, a metallic nozzle plate 4 having a plurality of nozzles 2, a metallic orifice plate 8 having a plurality of orifices 6, and a channel plate 10 are superposed on each other such that the channel plate 10 is interposed between the plates 4, 8, and these plates 4, 8, 10 are bonded together into an ink nozzle member 16. In this ink nozzle member 16, there are formed a plurality of ink discharge channels 12 for leading or guiding an ink material to the respective nozzles 2, and at least one ink supply channel 14 for leading or supplying the ink material to the orifices 6. Reference numeral 25 denotes an actuator which includes a substrate 24 consisting of a closure plate 18 and a spacer plate 20 both made of a metal or synthetic resin, and a plurality of piezoelectric/electrostrictive elements 28 formed on an outer surface of the closure plate 18. The closure plate 18 and spacer plate 20 are superposed on each other and formed integrally into the substrate 24, such that a plurality of voids 22 which correspond to the nozzles 2 and orifices 6 of the ink nozzle member 16 are formed in the substrate 24. The piezoelectric/electrostrictive elements 28 fixed to the closure plate 18 are aligned with the voids 22 of the substrate 24, as viewed in the plane of the substrate 24 (perpendicular to the direction of the thickness of the substrate 24). With the ink nozzle member 16 and the actuator 25 superposed on each other and bonded together by a suitable adhesive 29, each of the voids 22 provides a pressure chamber 26 formed behind the corresponding nozzle and orifice 2, 6 and filled with the ink material. In operation, the piezoelectric/electrostrictive elements 28 are selectively actuated to deform walls defining the corresponding pressure chamber or chambers 26, as schematically shown in FIG. 6, so as to change the pressure of the selected pressure chamber(s) 26.

In the ink jet print head as described above, the ink nozzle member 16 is bonded to the actuator 25, more precisely, to the surface of the spacer plate 20 on which the voids 22 are open. In this arrangement, a fluid-tight seal between the ink nozzle member 16 and the actuator 25 must be secured over a relatively large area surrounding the voids 22. Upon mass production of print heads of the above type, therefore, it is difficult for the print heads to assure a high degree of sealing reliability or fluid tightness and desired ink-jetting capability with high stability.

In view of the above problems, an actuator 40 as schematically shown in FIG. 7*a* has been proposed by the present inventors in co-pending U.S. patent application Ser. Nos. 08/066,193 and 08/066,195. This actuator 40 includes a ceramic substrate 38 having a plurality of pressure chambers 36 formed therein, and a plurality of film-like piezoelectric/electrostrictive elements 33 formed on the substrate 38. More specifically, ceramic green sheets for a spacer plate 30, a closure plate 32 and a connecting plate 34 are laminated on each other and co-fired into the ceramic substrate 38, such that the closure plate 32 is superposed on one surface of the spacer plate 30, and the connecting plate 34 having through-holes 35 is superposed on the other surface of the spacer plate 30. The piezoelectric/electrostrictive elements 33 are formed on the outer surface of the closure plate 32 by a film forming methods. When this actuator 40 is bonded to an ink nozzle member 42 by an adhesive 46, such that the communication holes 35 of the connecting plate 34 are aligned with nozzles 44 formed through the ink nozzle member 42, a fluid-tight seal needs to be provided only over a relatively small area surrounding the through-holes 35, readily assuring improved sealing reliability upon mass production of the print heads.

However, a further study by the inventors on the actuator 40 as described above revealed that the pressure chambers 36 are substantially entirely defined or surrounded by the integral ceramic substrate 38, whereby the ceramic substrate 38 is less likely to be deformed or displaced to change the pressure of the pressure chambers 36, due to increased rigidity of the substrate 38, as shown in FIG. 7*b*. Consequently, the operating characteristics of the actuator 40 may deteriorate, and the ink jet print head using the actuator 40 as an ink pump may not be able to provide desired ink-jetting capability.

SUMMARY OF THE INVENTION

It is therefore a first object of the present invention to provide an actuator having a pressure chamber or chambers substantially entirely defined by an integral ceramic substrate, in which the rigidity of the ceramic substrate is lowered enough to facilitate pressure changes of the pressure chamber(s), assuring desired operating characteristics of the actuator, while requiring a reduced seal area over which a fluid-tight seal should be provided upon bonding of the actuator to another member.

It is a second object of the invention to provide an ink jet print head having an ink nozzle member and the above-described actuator as an ink pump member, which print head assures improved bonding reliability between the ink nozzle member and the actuator, and stably exhibits excellent ink-jetting characteristics.

The above first object may be accomplished according to one aspect of the present invention, which provides an actuator comprising: a ceramic substrate in which at least one pressure chamber is formed, the ceramic substrate including a spacer plate having at least one window which provides the above-indicated at least one pressure chamber, a closure plate superposed on one of opposite major surfaces of the spacer plate, for closing one of opposite openings of each window, and a connecting plate superposed on the other major surface of the spacer plate, for substantially closing the other opening of the window, the connecting plate having at least one slit which corresponds to each pressure chamber, the spacer plate, the closure plate and the connecting plate being formed from respective ceramic green sheets which are laminated on each other and fired into an integral ceramic structure as the ceramic substrate; and at least one piezoelectric/electrostrictive element each disposed on a portion of the closure plate defining the corresponding pressure chamber, for deforming the portion so as to change a pressure of the corresponding pressure chamber, each piezoelectric/electrostrictive element comprising a pair of electrodes and a piezoelectric/electrostrictive layer, which are formed by a film-forming method on an outer surface of the closure plate of the ceramic substrate, such that the piezoelectric/electrostrictive layer is interposed between the pair of electrodes.

In the actuator constructed as described above, the ceramic substrate has a relatively small opening at its surface to be bonded to another member or component, thus requiring a fluid-tight seal to be provided over a relatively small area of the bonding surface of the substrate. Further, the provision of the slits leads to an increase amount of flexural deformation of walls (the ceramic substrate) defining the pressure chambers, and therefore assures excellent operating characteristics of the actuator.

The above-indicated second object of the invention may be accomplished according to another aspect of the present invention, which provides an ink jet print head comprising: an ink nozzle member having a plurality of nozzles through which fine particles of ink are jetted; and an actuator disposed on and bonded to the ink nozzle member and having a plurality of pressure chambers formed behind the respective nozzles of the ink nozzle member, the actuator comprising (a) a ceramic substrate including a spacer plate having a plurality of windows which provide the pressure chambers, a closure plate superposed on one of opposite major surfaces of the spacer plate, for closing one of opposite openings of each window, and a connecting plate superposed on the other major surface of the spacer plate and on the ink nozzle member, for substantially closing the other opening of the window, the connecting plate having at least one slit which corresponds to each pressure chamber, and a plurality of first communication holes located behind the respective nozzles of the ink nozzle member, for permitting fluid communication between the corresponding nozzles and pressure chambers, the spacer plate, the closure plate and the connecting plate being formed from respective ceramic green sheets which are laminated on each other and fired into an integral ceramic structure as the ceramic substrate, and (b) a plurality of piezoelectric/electrostrictive elements each disposed on a portion of the closure plate defining a corresponding one of the pressure chambers, for deforming the portion so as to change a pressure of the corresponding pressure chamber, whereby the ink in the pressure chamber is jetted through the corresponding one of the nozzles of the ink nozzle member, each piezoelectric/electrostrictive elements comprising a pair of electrodes and a piezoelectric/electrostrictive layer, which are formed by a film-forming method on an outer surface of the closure plate of the ceramic substrate, such that the piezoelectric/electrostrictive layer is interposed between the pair of electrodes.

In the ink jet print head constructed as described above, the fluid tightness of an ink flow channel through which the ink flows through the print head is significantly improved at the bonding surfaces of the actuator and ink nozzle member, assuring excellent operating characteristics of the actuator and excellent ink-jetting capability of the print head. Thus, the present print head is capable of producing improved quality of printed images with high stability.

BRIEF DESCRIPTION OF THE DRAWINGS

The above and optional objects, features and advantages of the present invention will be better understood by reading the following detailed description of presently preferred embodiments of the invention, when considered in connection with the accompanying drawings, in which:

FIG. 7*a* is a cross sectional view corresponding to that of FIG. 6, showing another example of ink jet print head when its actuator does not undergo displacement;

FIG. 7*b* is a cross sectional view corresponding to that of FIG. 6, showing the ink jet print head of FIG. 7*a* when the actuator undergoes displacement to change the pressure of one of its pressure chambers;

DETAILED DESCRIPTION OF THE PREFERRED EMBODIMENTS

Figure 1:
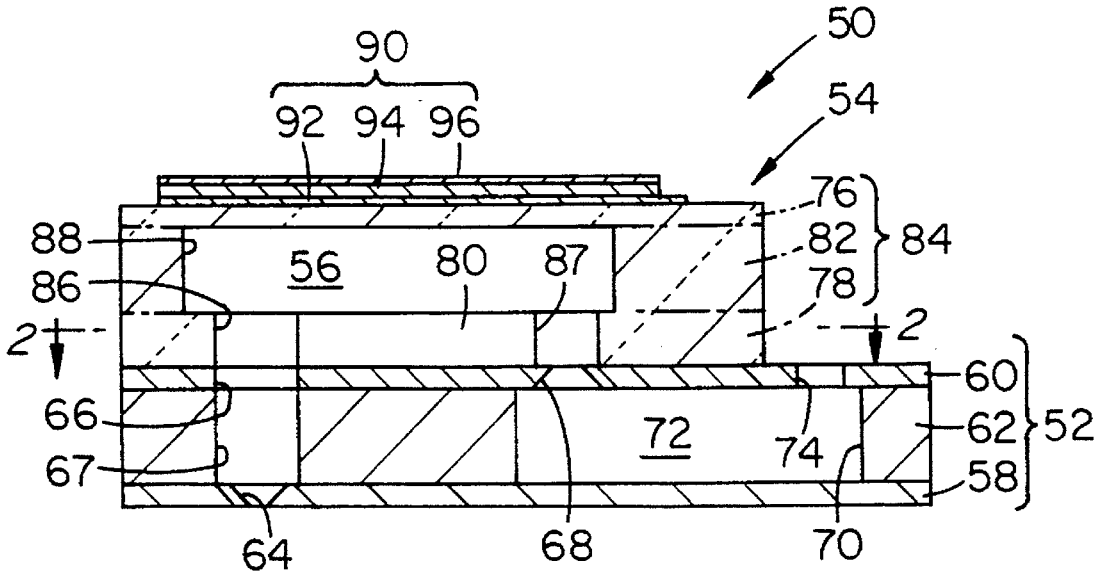
FIG. 1 is an elevational view in vertical cross section, showing one embodiment of an ink jet print head of the present invention.
Figure 2:
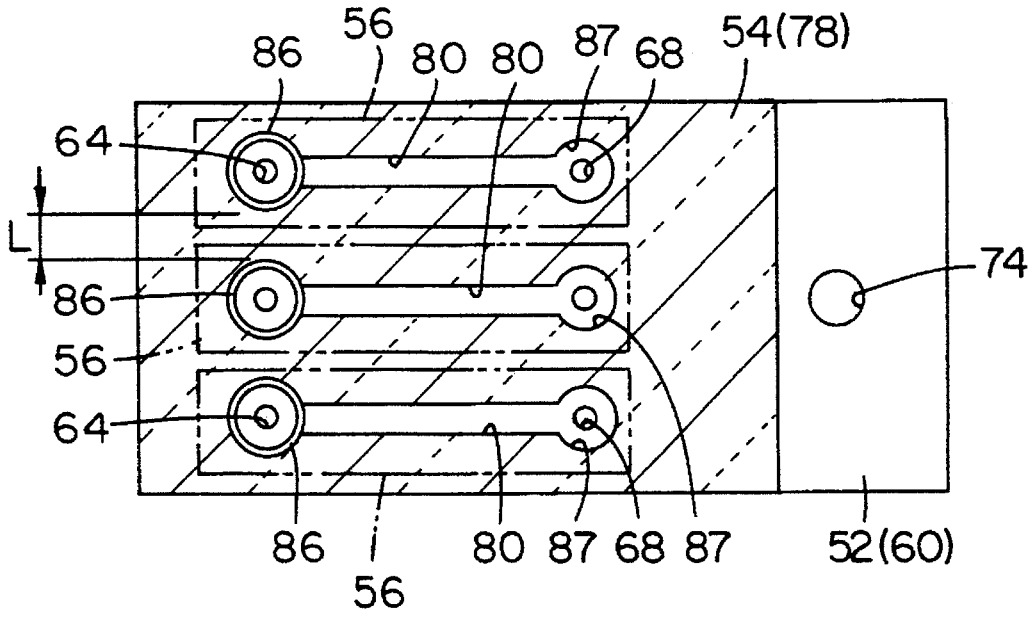
FIG. 2 is a cross sectional view taken along line 2—2 of FIG. 1.
Figure 3:
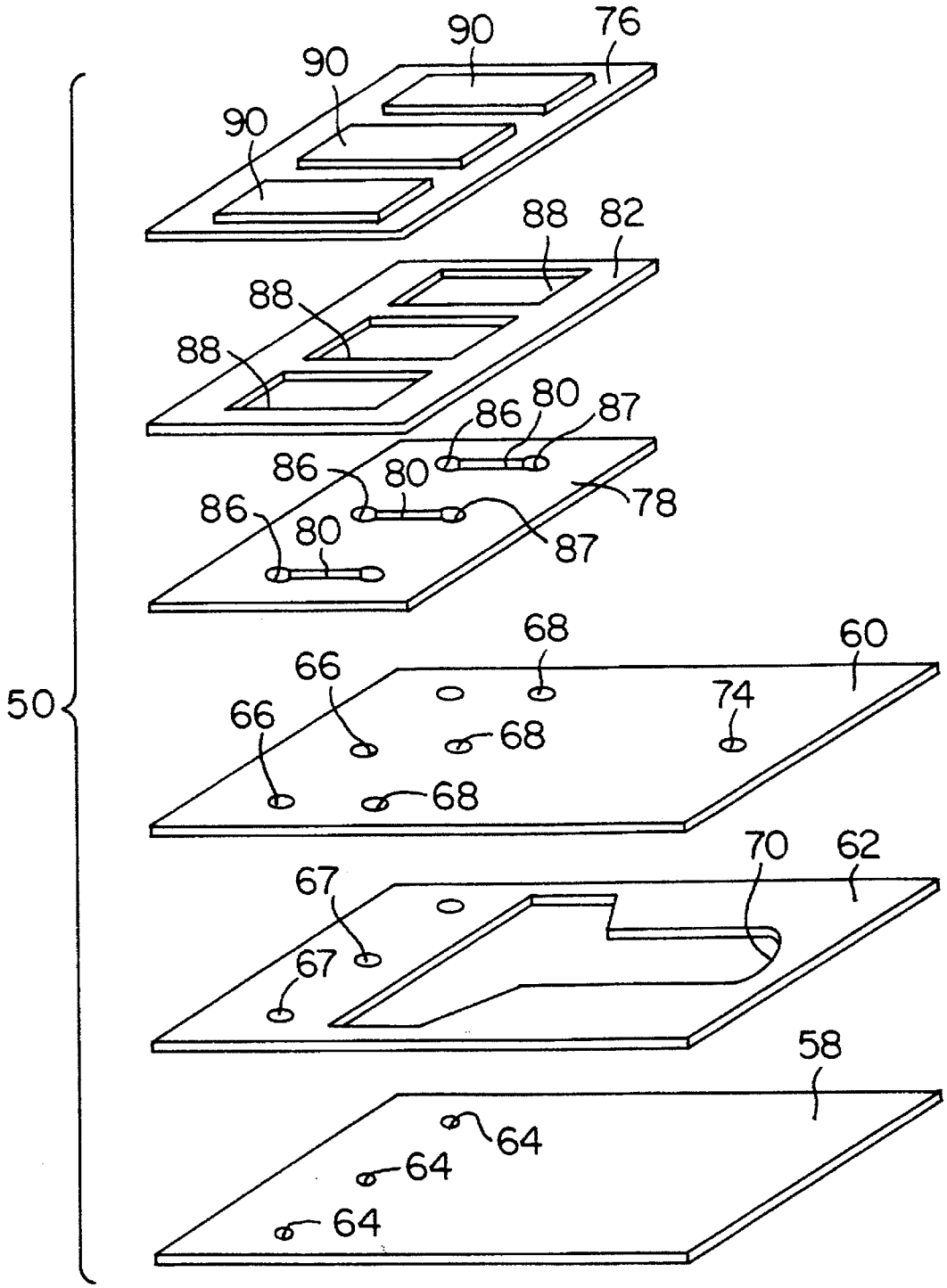
FIG. 3 is an exploded perspective view showing the structure of the ink jet print head of FIG. 1.

Referring first to FIGS. 1 and 2 schematically showing an ink jet print head 50 constructed according to the present invention, and to FIG. 3 which is an exploded perspective view of the print head 50, an ink nozzle member 52 and an actuator 54 used as an ink pump are bonded together to form an integral structure of the print head 50. In this print head 50, an ink material is supplied to a plurality of pressure chambers 56 formed in the actuator 54, and is jetted or discharged from a plurality of nozzles 64 formed through the ink nozzle member 52.

More specifically, the ink nozzle member 52 consists of a nozzle plate 58 and an orifice plate 60 both having a relatively small thickness, and a channel plate 62 interposed between these plates 58, 60. The nozzle plate 58 and the orifice plate 60 are integrally bonded to the channel plate 62 by means of an adhesive.

The nozzle plate 58 has the above-indicated nozzles 64 (three in this embodiment) formed through the thickness thereof for permitting jets of fine ink particles, while the orifice plate 60 and the channel plate 62 have respective through-holes 66, 67 formed through the thickness thereof. These through-holes 66, 67 are aligned with the respective nozzles 64, as viewed in the plane perpendicular to the thickness of the ink nozzle member 52, and have a diameter which is larger by a given value than that of the nozzles 64.

The orifice plate 60 further has a plurality of orifices 68 (three in this embodiment) formed therethrough, for permitting flow of the ink into the respective pressure chambers 56. The channel plate 62 is formed with a window 70 which is closed at its opposite openings by the nozzle plate 58 and the orifice plate 60, respectively, whereby an ink supply channel 72 communicating with the orifices 68 is defined by the channel plate 62, nozzle plate 58 and orifice plate 60. The orifice plate 60 further has a supply port 74 through which the ink is fed from an ink reservoir into the ink supply channel 72.

While the material for the plates 58, 60, 62 of the ink nozzle member 52 is not particularly limited, these plates 58, 60, 62 are preferably made of a plastic, or a metal such as nickel or stainless steel, which permits highly accurate formation of the nozzles 64 and orifices 68. Each of the orifices 68 is desirably formed in tapered shape such that the diameter of the orifice 68 is reduced in the direction of flow of the ink (i.e., in the direction from the ink supply channel 72 toward the pressure chambers 56), as shown in FIG. 1 by way of example, so as to function as a check valve for inhibiting the ink from flowing in the reverse direction.

On the other hand, the actuator 54 includes a ceramic substrate 84 consisting of a closure plate 76 and a connecting plate 78 both having a relatively small thickness and formed of a ceramic material, and a spacer plate 82 also formed of a ceramic material. These plates 76, 78, 82 are superposed on each other and formed integrally into the ceramic substrate 84, such that the spacer plate 82 is interposed between the closure plate 76 and connecting plate 78. The actuator 54 further includes a plurality of piezoelectric/electrostrictive elements 90 formed on the outer surface of the closure plate 76 by a film forming method. The piezoelectric/electrostrictive elements 90 are respectively aligned with the above-indicated pressure chambers 56 formed within the actuator 54, as viewed in the plane of the substrate 84 (perpendicular to the direction of the thickness of the substrate 84).

More specifically, the connecting plate 78 of the ceramic substrate 84 has first communication holes 86 and second communication holes 87 formed therethrough, which are respectively aligned with the through-holes 66 and orifices 68 formed in the orifice plate 60 of the ink nozzle member 52, as viewed in the plane perpendicular to the direction of the thickness of the plates 78, 60. The diameter of the first communication holes 86 is substantially equal to or slightly larger than that of the through-holes 66, and the diameter of the second communication holes 87 is larger by a given value than that of the orifices 68.

The spacer plate 82 has a plurality of rectangular windows 88 (three in this embodiment) formed therethrough. The spacer plate 82 is superposed on the connecting plate 78 such that each of the windows 88 communicates with the corresponding pair of the first and second communication holes 86, 87 formed in the connecting plate 78. The shape of the window 88 is not necessarily limited to a rectangular shape as illustrated in FIG. 3, but may be selected from other shapes, such as a generally oblong shape in which the opposite short sides of a rectangular window are curved.

The closure plate 76 is superposed on the surface of the spacer plate 82 remote from the connecting plate 78, so that the windows 88 are closed at the opposite openings thereof by the closure plate 76 and connecting plate 78. Thus, the pressure chambers 56 formed in the ceramic substrate 84 are held in communication with the exterior space through the first and second communication holes 86, 87.

The connecting plate 78 is further formed with a plurality of slits 80 which correspond to the respective pressure chambers 56, in other words, are respectively aligned with the pressure chambers 56, as viewed in the plane perpendicular to the direction of the thickness of the plates 78, 82. These slits 80 are formed through the thickness of the connecting plate 78 in the following manner. Initially, a ceramic slurry is prepared from a ceramic material, a binder, a suitable solvent and others, and the thus prepared ceramic slurry is formed into a green sheet which gives the connecting plate 78, by means of a known device, such as a doctor blade device or a reverse roller coater. Then, either before or after firing of the green sheet, the slits 80 connecting the first and second communication holes 86, 87 are formed by cutting using a dicer, slicer or a laser beam, or by punching or piercing. With the slits 80 thus formed, the rigidity of the ceramic substrate 84 can be lowered enough to significantly increase an amount of deformation of the substrate 84 or pressure chambers 56, thereby causing increased pressure changes of the pressure chambers 56 which lead to improved operating characteristics of the actuator 54. At the same time, the actuator 54 requires a relatively small seal area over which a fluid-tight seal must be provided between the ink nozzle member 52 and the ceramic substrate 84 (actuator 54) when the nozzle member 52 is bonded to the substrate 84.

The ceramic substrate 84 as described above is formed as an integral fired ceramic structure. More specifically, green sheets for the closure plate 76, connecting plate 78 and spacer plate 82 are laminated on each other, and then fired into the integral structure. The thus formed ceramic substrate 84 assures complete sealing between the adjacent plates 76, 78, 82, without applying any adhesive to their interfaces, for example. Further, the ceramic substrate 84, which includes the connecting plate 78, exhibits improved structural strength, which favorably prevents warpage of the substrate 84 upon firing thereof, and also permits easy handling of the substrate 84 while the print head 50 is being produced or in use.

It is generally difficult to handle a laminar structure consisting of thin, flexible green sheets. For example, such a laminar structure is likely to be broken, or abnormally deformed after firing thereof, due to stresses applied thereto, unless the structure is carefully supported or handled upon its setting in a firing furnace. According to the present invention, however, the rigidity of the laminar structure (ceramic substrate 84) is advantageously increased due to the presence of the connecting plate 78, whereby the structure or substrate 84 can be more easily handled, and defects due to handling failures are less likely to occur, as compared with the case where the laminar structure does not include the connecting plate 78. Where the pressure chambers 56 are formed with high density in the actuator 54, in other words, where the actuator 54 has a relatively large number of pressure chambers 56 per area, it is almost impossible to handle a structure consisting only of the closure plate 76 and spacer plate 82 without causing any problem. Even in this case, the presence of the connecting plate 78 in the laminar structure of the instant embodiment readily permits safe handling of the ceramic substrate 84.

While the ceramic material for forming the ceramic substrate 84 is not particularly limited, alumina, zirconia or the like may be favorably employed in view of its formability and other properties. Further, the closure plate 76, connecting plate 78 and spacer plate 82 are desirably formed from green sheets having substantially the same ceramic composition and distribution in grain size, so as to achieve good sinterability and matching of coefficients of the thermal expansion of the plates 76, 78, 82.

In the ceramic substrate 84 as described above, the thickness of the closure plate 76 is preferably 50 82 m or smaller, more preferably, in a range of about 3~20 μm. The thickness of the connecting plate 78 is preferably 10 μm or greater, more preferably, 50 μm or greater. The thickness of the spacer plate 82 is preferably 50 μm or greater, more preferably, 100 μm or greater.

The piezoelectric/electrostrictive elements 90 are formed on the outer surface of the ceramic substrate 84 in alignment with the respective pressure chambers 56. Each of these elements 90 has a lower electrode 92, a piezoelectric/electrostrictive layer 94 and an upper electrode 96 formed on the substrate 84 in this order by a film forming method. As the piezoelectric/electrostrictive element 90 of the instant embodiment, it is particularly preferable to employ a piezoelectric/electrostrictive element as proposed in U.S. patent application Ser. No. 07/912,920 assigned to the same assignee as the present patent application.

While the configuration of the actuator 54 varies depending upon various factors relating to its production, it is desirable to assure sufficiently high smoothness or evenness of the surface of the actuator 54 which is bonded to the ink nozzle member 52, that is, the outer surface of the connecting plate 78. The evenness of the above-indicated surface of the actuator 54 is suitably controlled such that this surface has the maximum waviness of not greater than 50 μm as measured along a reference length of 8 mm, by means of a roughness measuring system. Desirably, the maximum waviness of the relevant surface is not greater than 25 μm, more desirably, not greater than 10 μm. As a means for achieving the above degree of surface evenness, the integral ceramic substrate 84 which has been fired may be subjected to machining such as lapping or surface grinding.

On the outer surface of the closure plate 76 of the ceramic substrate 84 are formed electrode films (for the upper and lower electrodes 96, 92) and the piezoelectric/electrostrictive layer 94, by any one of various known methods which include thick-film forming process such as screen printing, spraying, dipping and coating, and thin-film forming process such as ion-beam method, sputtering, vacuum vapor deposition, ion plating, CVD and plating. These films and layer 92, 94, 96 may be formed either before or after firing of the closure plate 76 (the ceramic substrate 84).

Conventionally, when the films 92, 94, 96 of the piezoelectric/electrostrictive elements 90 are formed and fired after the ceramic substrate 84 is fired, the elements 90 suffer from residual strains due to thermal contraction thereof, during a cooling process after the firing, since the ceramic material for the substrate 84 and the materials for the elements 90 have different coefficients of thermal expansion. As a result, the residual strains may deteriorate the operating characteristics of the elements 90. In the actuator 50 of the present invention, the pressure chambers 56 are more likely to be deformed with the slits 80 formed through the connecting plate 78 of the ceramic substrate 84. Therefore, the residual strains as described above can be effectively reduced, and do not affect the performance of the piezoelectric/electrostrictive elements 90.

The upper and lower electrode films 96, 92 and piezoelectric/electrostrictive layer 94 formed on the closure plate 76 may be heat-treated as needed, either in different steps following formation of the respective films and layer 92, 94, 96, or in one step following formation of all of the films and layer 92, 94, 96.

The upper and lower electrode films 96, 92 of each piezoelectric/electrostrictive element 90 may be formed of any electrically conductive material which can withstand a high-temperature oxidizing atmosphere generated upon the heat-treatment or firing as described above. For instance, the electrode films 96, 92 may be formed of a single metal, an alloy, a mixture of a metal or alloy and an electrically insulating ceramic or glass, or electrically conductive ceramic.

The piezoelectric/electrostrictive layer 94 of each piezoelectric/electrostrictive element 90 may be formed of any piezoelectric or electrostrictive material which produces a relatively large amount of strain or displacement due to the converse or reverse piezoelectric effect or the electrostrictive effect. The piezoelectric/electrostrictive material may be either a crystalline material or an amorphous material, and may be a semi-conductor material or a dielectric or ferroelectric ceramic material. Further, the piezoelectric/electrostrictive material may either require a treatment for initial polarization or poling, or may not require such a polarization treatment.

The piezoelectric/electrostrictive element 90 constructed as described above generally has a thickness of not larger than 100 μm. The thickness of each electrode film 96, 92 is generally 20 μm or smaller, preferably 5 μm or smaller. To assure a relatively large amount of displacement by application of a relatively low voltage, the thickness of the piezoelectric/electrostrictive layer 94 is preferably 50 μm or smaller, more preferably, in a range of 3 μm to 40 μm.

The piezoelectric/electrostrictive elements 90, which are supported by the closure plate 76 of the ceramic substrate 84, exhibit sufficiently high mechanical strength and toughness even though the elements 90 have a considerably small thickness. In addition, the film-forming method used for forming the electrode films 92, 96 and the piezoelectric/electrostrictive layer 94 permits a relatively large number of the piezoelectric/electrostrictive elements 90 to be formed on the closure plate 76. That is, in the film-forming process, the elements 90 can be concurrently and easily formed with minute spacing between adjacent elements 90, without using an adhesive or the like. Further, in order to assure improved reliability of insulation between the upper and lower electrodes 96, 92, there may be formed as needed an insulating resin layer between the adjacent piezoelectric/electrostrictive layers 94.

The above-described piezoelectric/electrostrictive elements 90 are formed integrally on the ceramic substrate 54, so as to constitute the intended actuator 54. This actuator 54 and the ink nozzle member 52 are superposed on each other, and bonded together by a suitable adhesive, into an integral structure of the ink jet print head 50, as shown in FIG. 1. In the thus formed ink jet print head 50, an ink material which is fed through the ink supply channel 72 is supplied to the pressure chambers 56 through the respective orifices 68, and is passed through the through-holes 66, 67 and jetted outwards from the nozzles 64, based on the operation of the piezoelectric/electrostrictive elements 90 of the actuator 54. Thus, an ink flow channel through which the ink flows through the instant ink jet print head 50 consists of the supply port 74, ink supply channel 72, orifices 68, second communication holes 87, pressure chambers 56, first communication holes 86, through-holes 66, 67 and nozzles 64.

The adhesive used for bonding the ink nozzle member 52 and the actuator 54 may be selected from various known adhesives, such as those of vinyl-type, acrylic-type and epoxy-type, or those containing polyamide, phenol, resorcinol, urea, melamine, polyester, furan, polyurethane, silicone, rubber, polyimide and polyolefin, provided the selected adhesive is resistant to the ink material.

It is desirable in terms of production efficiency that the adhesive is in the form of a highly viscous paste which can be applied by coating using a dispenser, or by screen-printing, or is in the form of a sheet which permits punching thereof. It is more desirable to use a hot-melt type adhesive which requires a relatively short heating time, or an adhesive which is curable at room temperature. The adhesive in the form of a highly viscous paste may be obtained by mixing an adhesive material with a filler so as to increase the viscosity of the resulting adhesive. It is also desirable to use a highly elastic adhesive so as to increase an amount of deformation of the pressure chambers 56 upon displacement of the piezoelectric/electrostrictive elements 90.

In particular, it is preferable to use an elastic epoxy adhesive or silicone-contained adhesive which can be applied by screen-printing, or sheet-like, hot-melt type adhesive containing polyolefin or polyester, which permits punching thereof. It is also possible to apply various adhesives as indicated above to different portions of the bonding surface(s) of the actuator 54 and/or the ink nozzle member 52.

When the actuator 54 and the ink nozzle member 52 are bonded together using the above adhesive, the pressure chambers 56 of the actuator 54 are held in communication with the nozzles 64 and ink supply channel 72 formed in the ink nozzle member 52, by communicating the first and second communication holes 86, 87 with the through-holes 66 and orifices 68 formed through the orifice plate 60 of the ink nozzle member 52.

Figure 4:
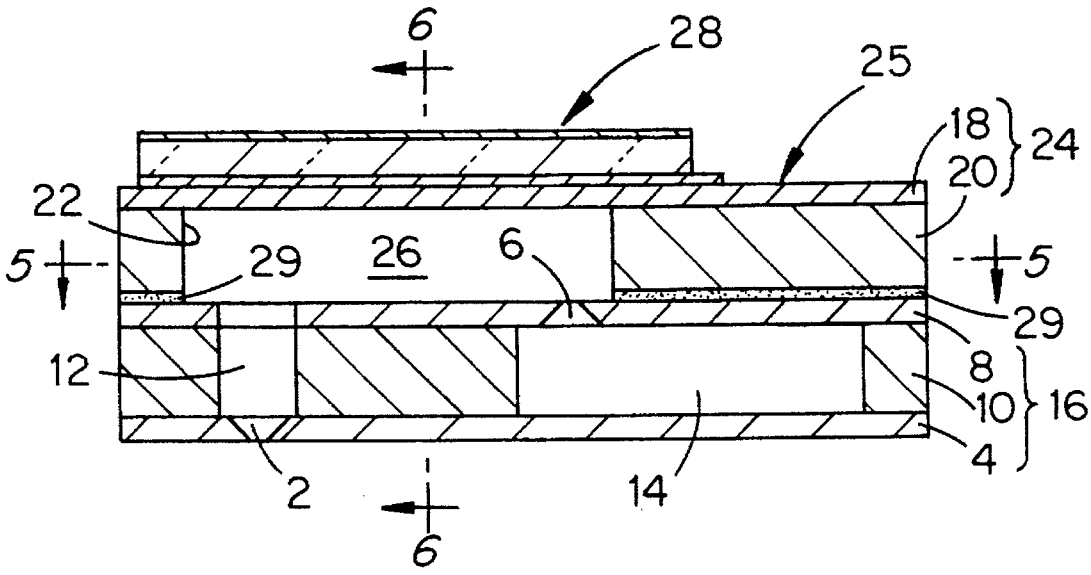
FIG. 4 PRIOR ART
FIG. 4 is an elevational view in vertical cross section corresponding to that of FIG. 1, showing one example of known ink jet print heads.
Figure 5:
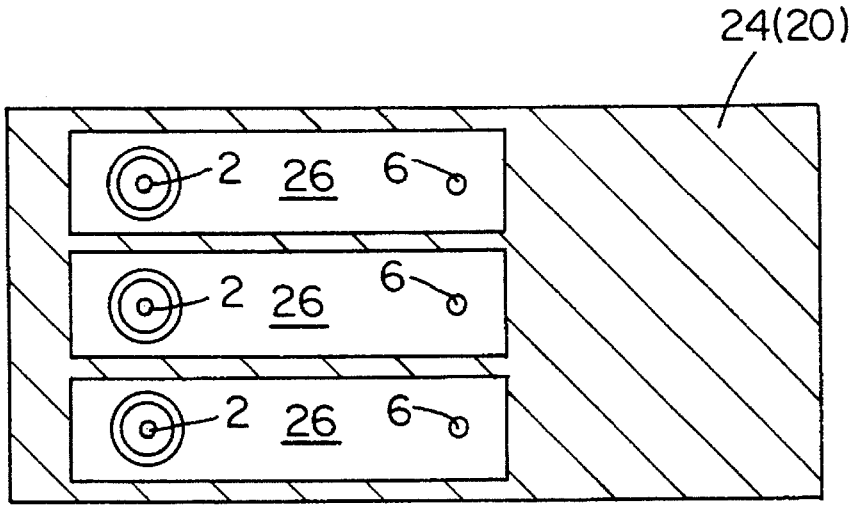
FIG. 5 PRIOR ART
FIG. 5 is a cross sectional view taken along line 5—5 of FIG. 4.
Figure 6:
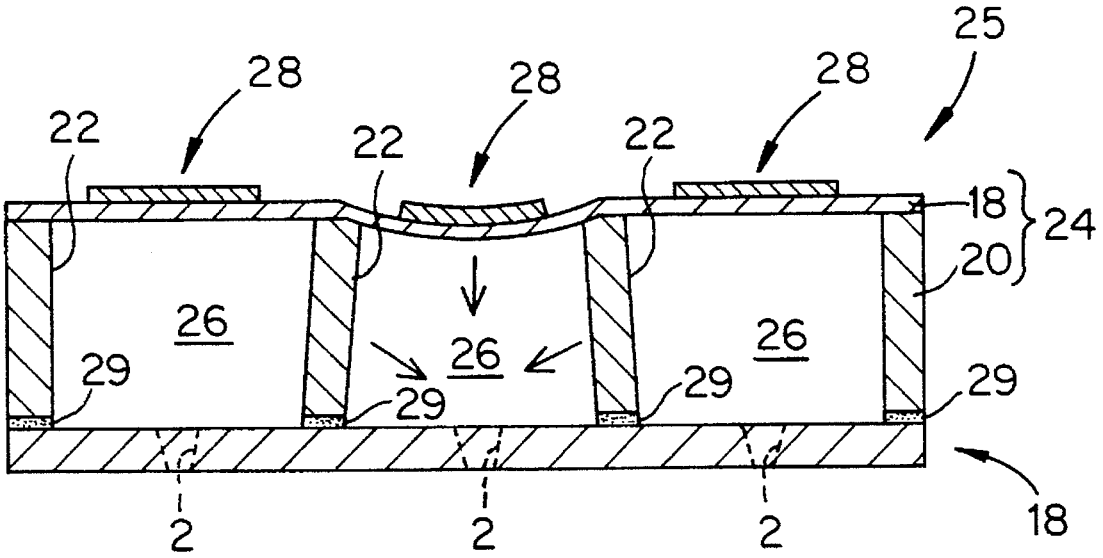
FIG. 6 PRIOR ART
FIG. 6 is a cross sectional view taken along line 6—6 of FIG. 4, showing an actuator of the print head of FIG. 4 when it undergoes displacement to change the pressure of one of its pressure chambers.

The fluid tightness of the ink flow channel at the bonding surfaces of the actuator 54 and ink nozzle member 52 can be satisfactorily established by providing seals over their regions surrounding the first and second communication holes 86, 87 and the slits 80 connecting the holes 86, 87. Thus, the present ink jet print head 50 requires a significantly reduced area of the bonding surfaces which must be sealed so as to stably establish a high degree of fluid tightness of the ink flow channel. This advantage will be readily appreciated by comparing the construction of the instant embodiment with that of the known ink jet print head as shown in FIGS. 4 and 5, in which a fluid-tight seal between the ink nozzle member 16 and the actuator 25 needs to be provided around the openings of the relatively large voids 22.

In the instant embodiment, in particular, the diameters of the first and second communication holes 86, 87 are set to be smaller than the width dimension of the pressure chamber 56 (the width dimension of the window 88 formed through the spacer plate 82). Therefore, adjacent first communication holes 86 and adjacent second communication holes 87 are spaced apart from each other by a sufficiently large distance (indicated by "L" in FIG. 2). This arrangement assures a sufficiently large bonding area between the actuator 54 and the ink nozzle member 52, around the respective first and second communication holes 86, 87. Accordingly, further improved fluid tightness between the bonding surfaces of the actuator 54 and ink nozzle member 52 can be achieved even if these members 54, 52 are made of different kinds of materials.

When the actuator 54 with a bonding surface coated with an adhesive is superposed on the ink nozzle member 52, and is pressed against the nozzle member 52 so as to achieve good bonding strength, the adhesive may overflow into the openings of the actuator 54, that is, the first and second communication holes 86, 87 and slits 80. In the instant embodiment, the slits 80 serve to increase the total area of the openings of the actuator 54, and the adhesive may overflow into the slits 80 as well as the communication holes 86, 87 when a relatively large force is applied to the actuator 54 for improved bonding strength. This arrangement favorably prevents the first and second communication holes 86, 87 from being closed by the adhesive. Accordingly, the ink jet print head 50 can be produced with improved bonding efficiency, assuring excellent bonding and sealing strength, due to increases in the permissible ranges of the amount of the force applied to the actuator 54 and the time of the application of the force, for bonding the actuator 54 and the ink nozzle member 52 together without closing the first and second communication holes 86, 87.

Figure 8A:
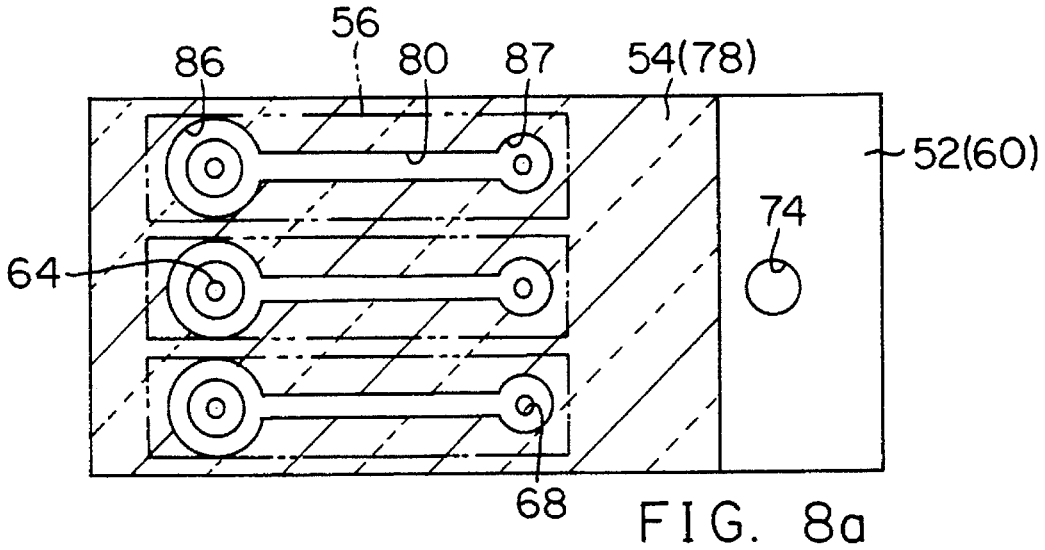
FIG. 8*a* is a cross sectional view corresponding to that of FIG. 2, showing one modification of the ink jet print head of FIG. 1 in which the size of first communication holes is changed.
Figure 8B:
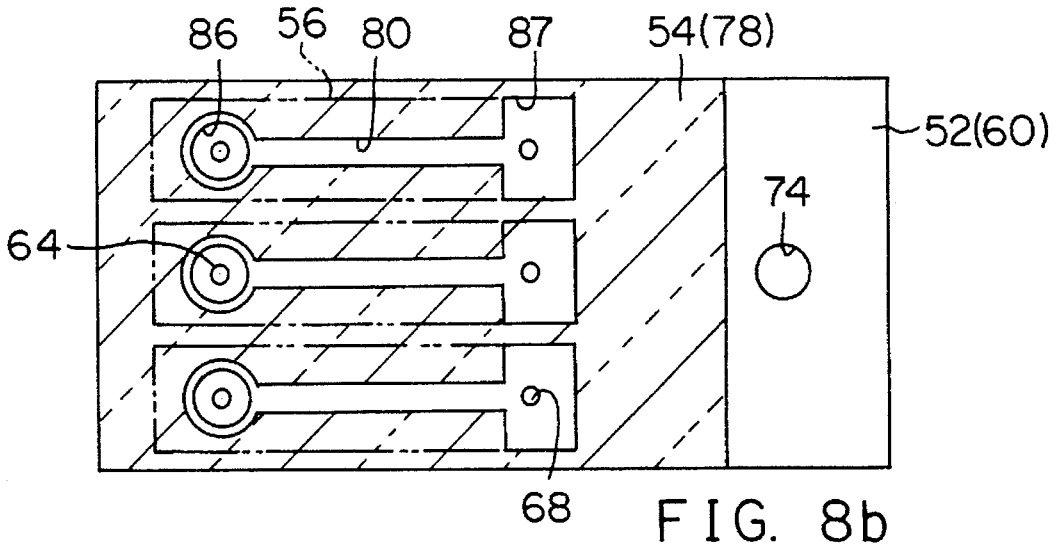
FIG. 8*b* is a cross sectional view corresponding to that of FIG. 2, showing another modification of the ink jet print head of FIG. 1 in which the size and shape of second communication holes are changed.
Figure 8C:
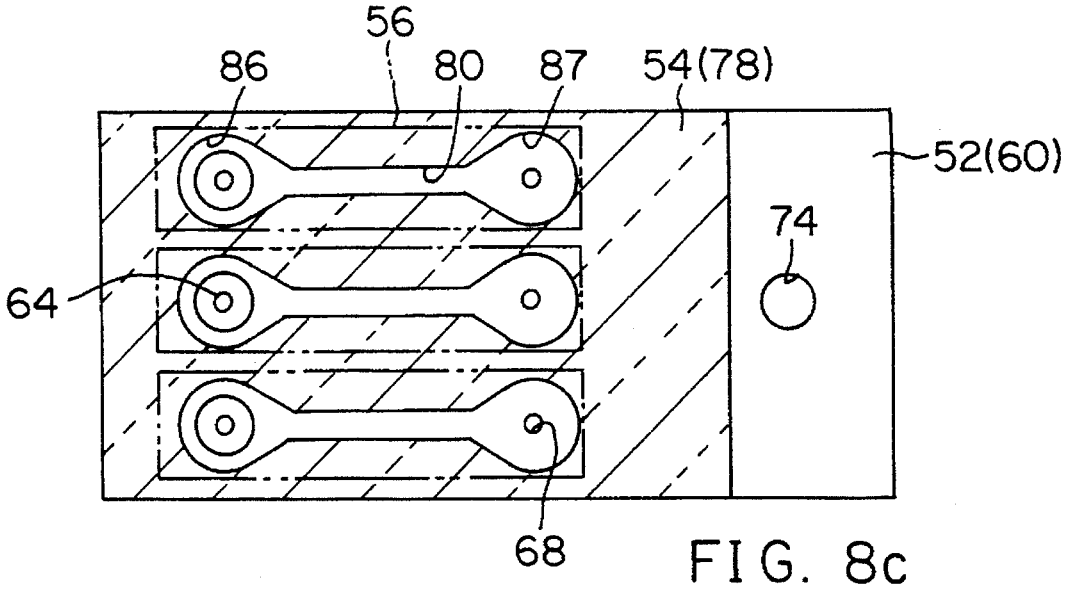
FIG. 8*c* is a cross sectional view corresponding to that of FIG. 2, showing a further modification of the ink jet print head of FIG. 1 in which the first and second communication holes are formed in teardrop shape.

Depending upon the kind of the adhesive used or the method of application of the adhesive, the amount of the overflowing adhesive is increased so much as to close the first and second communication holes 86, 87, even in the presence of the slits 80. In this case, it is desirable that the diameter of the first or second communication holes 86, 87 be set to be substantially equal to the width dimension of the corresponding pressure chamber 56, as shown in FIGS. 8*a* and 8*b*, so as to avoid the closure of the holes 86, 87 or the ink flow channel. It is also desirable to form one or both of the first and second communication holes 86, 87 in teardrop shape as shown in FIG. 8*c*, or elliptic shape, so as to allow the ink to flow smoothly through the print head 50.

In the ink jet print head 50 constructed as described above, the fluid tightness of the ink flow channel can be easily and stably established, and the actuator 54 exhibits improved operating characteristics, due to the formation of the slits 80 in the connecting plate 78. Accordingly, the present print head 50 assures excellent ink-jetting capability with high stability.

A sample of the print head 50 as illustrated in FIGS. 1 through 3 was produced in which the connecting plate 78 of the actuator 54 was formed with the first and second communication holes 86, 87 and the slits 80. When a given voltage was applied to the piezoelectric/electrostrictive element 90 of the thus produced print head 50, the amount of flexural deformation of the actuator 54, which was measured by a laser Doppler measuring device, was 0.29 μm. With respect to a comparative sample of print head in which only the first and second communication holes (but not the slits) were formed in the connecting plate, the amount of flexural deformation of the actuator was 0.21 μm. With respect to the known print head of FIGS. 4 and 5 in which the actuator does not include the connecting plate, the amount of flexural deformation was 0.29 μm. It will be recognized from these results that the formation of the slits in the connecting plate of the actuator leads to an increased amount of flexural deformation and improved operating characteristics of the actuator.

Figure 9:
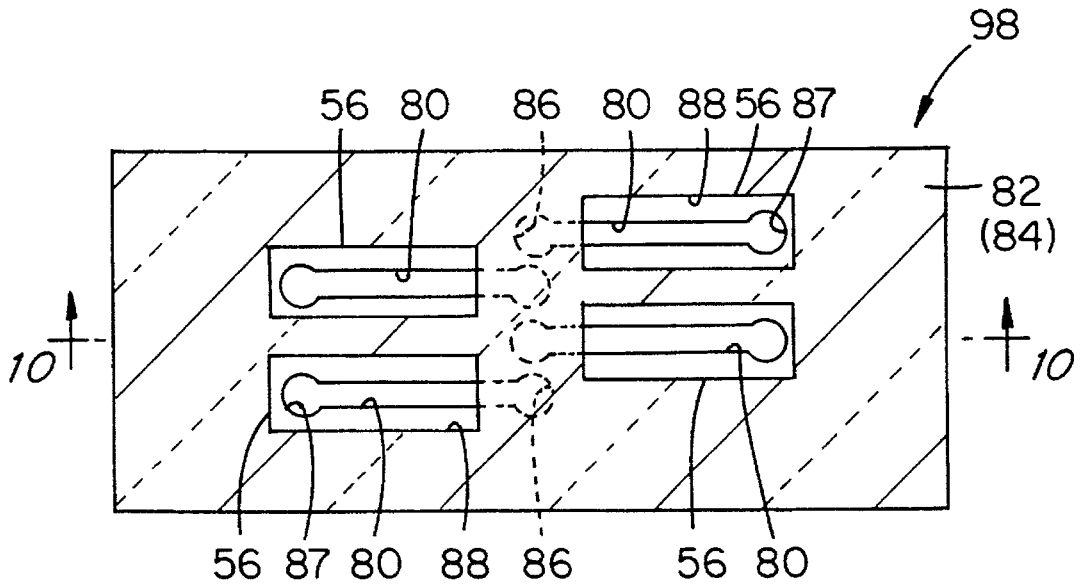
FIG. 9 is a transverse cross sectional view showing another embodiment of the actuator of the present invention.
Figure 10:
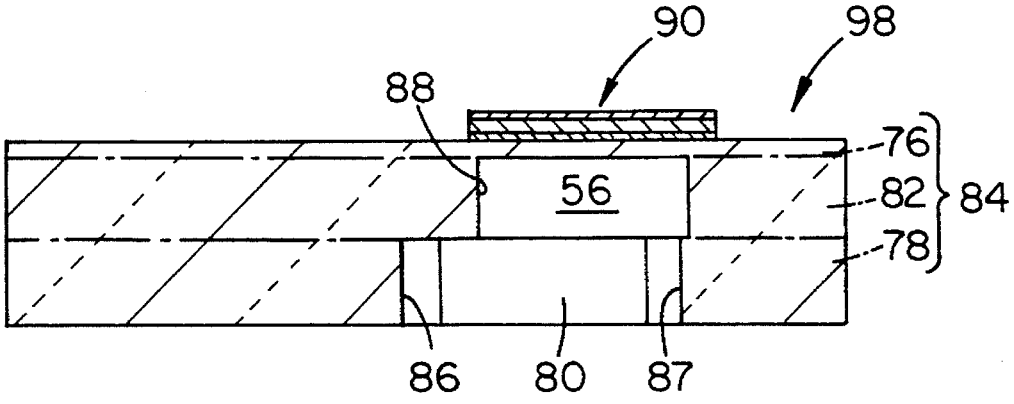
FIG. 10 is a cross sectional view taken along line 10—10 of FIG. 9.

Referring next to FIGS. 9 and 10, there will be described an actuator 98 as another embodiment of the present invention. In these figures, the same reference numerals as used in the above description of the actuator 54 of the previous embodiment will be used for identifying structurally and/or functionally corresponding elements, of which no detailed explanation will be provided.

This actuator 98 has four pressure chambers 56 which are formed in the ceramic substrate 84 in a zigzag fashion, as shown in FIG. 9. Namely, two rows (left and right in FIG. 9) each consisting of two of the pressure chambers 56 are disposed with one of the rows displaced relative to the other row in the width direction of the substrate 84, i.e., in the vertical direction in FIG. 9. The first communication holes 86 are formed in the portions of the connecting plate 78 between the left and right rows of the pressure chambers 56, and the slits 80 extend from the respective pressure chambers 56 to the corresponding first communication holes 86. In this arrangement, the first communication holes 86 can be arranged with increased density, that is, at a pitch substantially equal to or smaller than the width of the pressure chamber 56. When this actuator 98 is used for an ink jet print head, therefore, the pitch of nozzles that are aligned with the first communication holes 86 can be significantly reduced, whereby the print head is capable of performing highly accurate and high-quality printing. In this case, the slits 80 provide a part of the ink flow channel through which the ink flows through the print head, and is therefore required to have a sufficiently large width.

Figure 11:
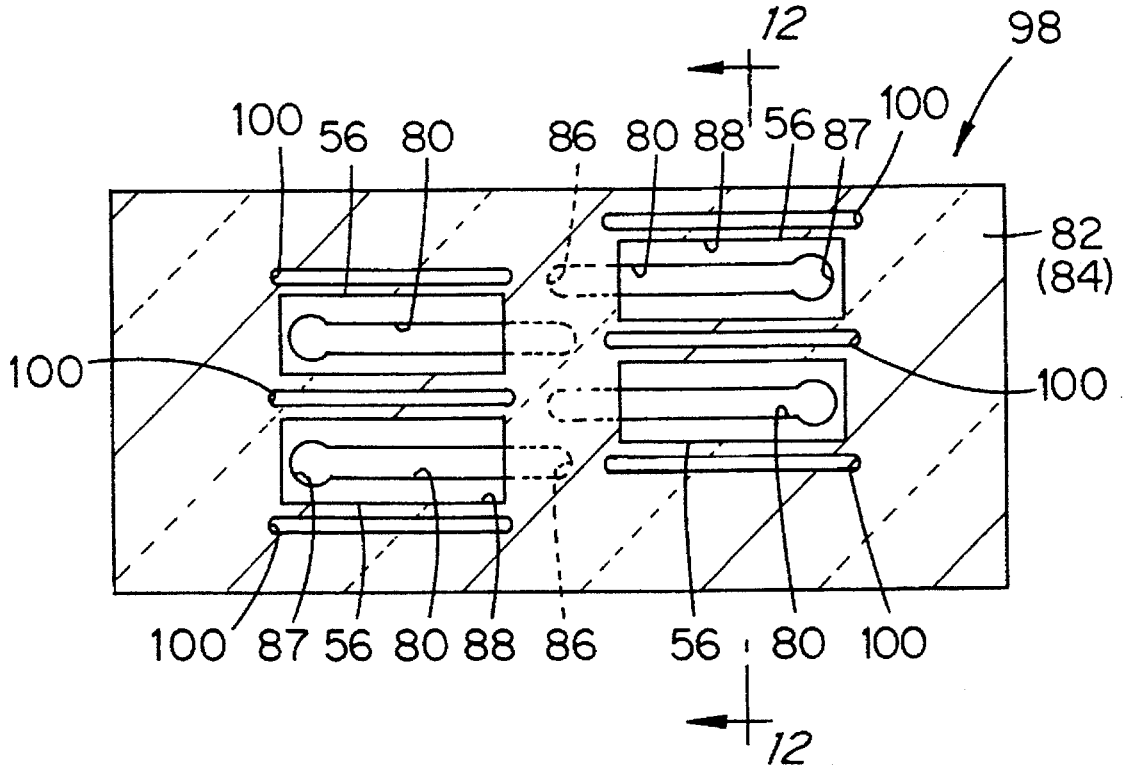
FIG. 11 is a transverse cross sectional view showing a modification of the actuator of FIG. 9 in which the shape of first communication holes is changed, and additional slits are formed in its ceramic substrate.
Figure 12A:
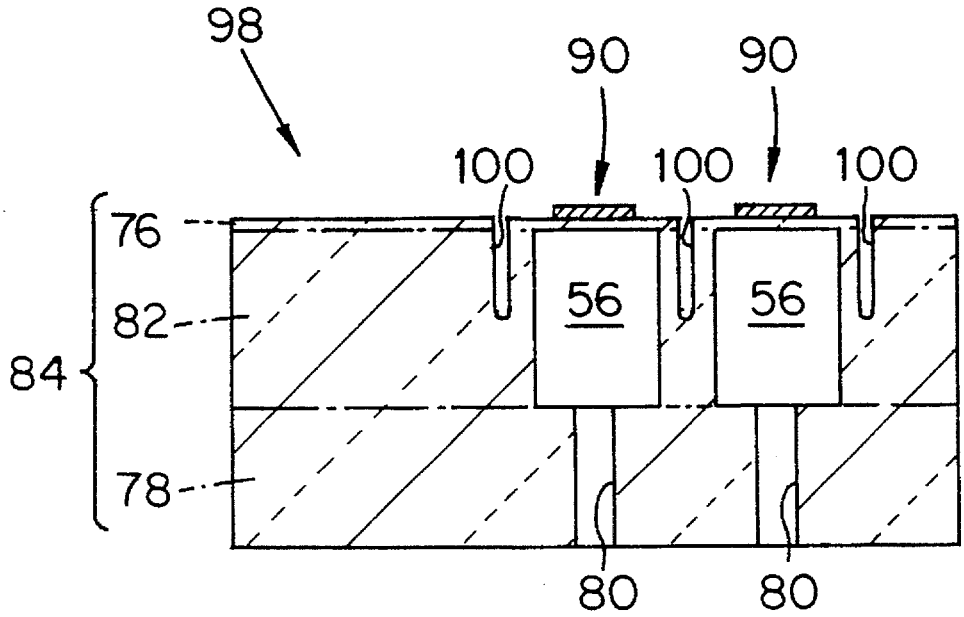
FIG. 12*a* is a cross sectional view taken along line 12—12 of FIG. 11, schematically showing the actuator of FIG. 11 which does not undergo displacement.
Figure 12B:
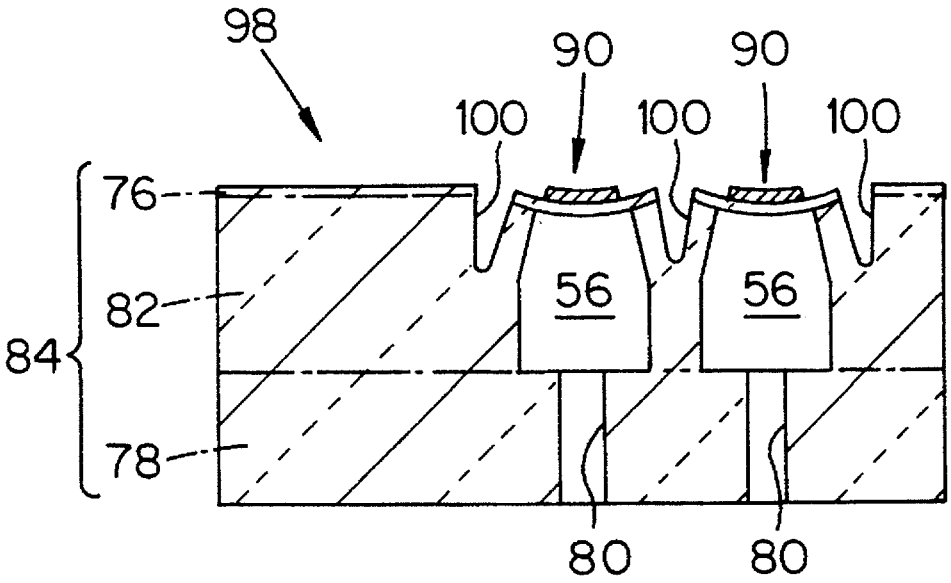
FIG. 12*b* is a cross sectional view taken along line 12—12 of FIG. 11, schematically showing the actuator of FIG. 11 which undergoes displacement to change pressures of its pressure chambers.

Referring further to FIG. 11, the actuator 98 is modified in respect of the shape of the first communication holes 86, so that the holes 86 are arranged with further increased density or at a narrower pitch. The actuator 98 is also modified by providing additional slits 100 on the opposite sides of the pressure chambers 56 as viewed in the direction of the width of the chambers 56, as shown in FIGS. 11 and 12*a*, so as to increase the amount of displacement of the actuator 98. Since these slits 100 are formed in the upper portion of the spacer plate 82 to interpose the upper portion of the pressure chambers 56 therebetween, the rigidity of the ceramic substrate 84 can be advantageously reduced to allow easy deformation of the chambers 56, thereby permitting the actuator 98 to undergo an effectively increased amount of displacement, as shown in FIG. 12*b*.

While the present invention has been described in its presently preferred embodiments with a certain degree of particularity, it is to be understood that the invention is not limited to the details of the illustrated embodiments, but may be otherwise embodied.

For instance, the actuator constructed according to the present invention may be used as an ink pump for ink jet print heads having various other structures, and may also be used for microphones, piezoelectric loudspeakers, sensors, vibrators or resonators, filters and other components or devices.

The dimensions, shape, number and position of the slits 80 formed in the actuator 54 are not limited to those of the illustrated embodiments, but may be suitably selected provided the slits 80 serve to effectively increase the amount of deformation of the pressure chambers 56. While the ratio of the width of the slits 80 to that of the pressure chambers 56 (i.e., the width of the windows 88 formed in the spacer plate 82) is about 1:3 in the illustrated embodiments, the slits may be formed with almost no width by just cutting the surface of the ceramic substrate 84, so as to yield the above-described effects. Although it is desirable that each of the slits 80 be formed to connect the corresponding first and second communication holes 86, 87 as in the illustrated embodiments, the slit is not necessarily required to connect the holes 86, 87, but may be formed as a plurality of separate slit sections formed between the first and second communication holes 86, 87. Further, the slits 80 may extend in other directions than that of the illustrated embodiments.

Moreover, the construction and material of the ink nozzle member 52 are not limited to those of the illustrated embodiments. For instances, the whole or a part of the ink nozzle member 52 may be formed by injection molding, using synthetic resin or the like, or by other molding method. Furthermore, the positions, numbers and other parameters of the nozzles 64 and the orifices 68 formed in the ink nozzle member 52, and those of the pressure chambers 56 formed in the actuator 54 are by no means limited to those of the illustrated embodiments.

It is also to be understood that the present invention, may be embodied with various other changes, modifications and improvements, which may occur to those skilled in the art, without departing from the spirit and scope of the invention defined in the following claims.

What is claimed is:

1. An actuator comprising:

a ceramic substrate including a spacer plate having a first major surface opposite a second major surface and at least one window, a closure plate superposed on the first major surface of said spacer plate, and a connecting plate superposed on the opposite second major surface of said spacer plate, said closure plate and said connecting plate extending over and substantially closing said at least one window thereby forming at least one pressure chamber in the ceramic substrate, said connecting plate having a slit which corresponds to said at least one pressure chamber, said spacer plate, said closure plate and said connecting plate being formed from respective ceramic green sheets which are laminated on each other and fired into an integral ceramic structure as said ceramic substrate; and at least one piezoelectric/electrostrictive element disposed on a portion of said closure plate opposite said at least one pressure chamber, for deforming said portion to change a pressure within the at least one pressure chamber, said piezoelectric/electrostrictive element comprising a pair of electrodes and a piezoelectric/electrostrictive layer, which are formed by a film-forming method on an outer surface of said closure plate of said ceramic substrate, such that said piezoelectric/electrostrictive element is interposed between said pair of electrodes.

2. An actuator as defined in claim 1, wherein a single slit corresponds to said at least one pressure chamber.

3. An actuator as defined in claim 2, wherein said connecting plate further has at least one pair of first and second communication holes formed therethrough, each pair of which communicates with a corresponding one of said at least one pressure chamber, and each single slit interconnects a respective pair of first and second communication holes to each other.

4. An actuator as defined in claim 3, wherein said each pair of first and second communication holes is aligned with the corresponding said at least one pressure chamber.

5. An actuator as defined in claim 3, comprising a plurality of pressure chambers which are arranged in two rows, each of said first communication holes being located between said two rows of the pressure chambers.

6. An actuator as defined in claim 2, wherein each said single slit has a width which is one third of a width of the respective pressure chamber.

7. An actuator as defined in claim 2, wherein each said single slit extends in a direction of a length of the respective pressure chamber.

8. An actuator as defined in claim 1, wherein said ceramic substrate has additional slits which are formed in said closure plate and said spacer plate, such that an upper portion of said at least one pressure chamber is interposed between adjacent additional slits.

9. An actuator as defined in claim 1, wherein said closure plate of said ceramic substrate has a thickness of not larger than 50 μm.

10. An actuator as defined in claim 1, wherein said connecting plate has a thickness of not smaller than 10 μm.

11. An actuator as defined in claim 1, wherein said spacer plate has a thickness of not smaller than 50 μm.

12. An actuator as defined in claim 1, wherein said ceramic substrate is comprised of alumina or zirconia.

13. An ink jet print head comprising:

an ink nozzle member having a plurality of nozzles through which fine particles of ink are jetted; and an actuator disposed on and bonded to said ink nozzle member and having a plurality of pressure chambers formed behind respective nozzles of said ink nozzle member, said actuator comprising:

a ceramic substrate including a spacer plate having a first major surface opposite a second major surface and a plurality of windows, a closure plate superposed on the first major surface of said spacer plate, and a connecting plate interposed between the opposite second major surface of said spacer plate and ink nozzle member, said closure plate and said connecting plate extending over and substantially closing the plurality of windows thereby forming the plurality of pressure chambers, said connecting plate having at least one slit which corresponds to each of said plurality of pressure chambers, and a plurality of first communication holes located behind the respective nozzles of said ink nozzle member, for permitting fluid communication between the respective nozzles and plurality of pressure chambers said spacer plate, said closure plate and said connecting plate being formed from respective ceramic green sheets which are laminated on each other and fired into an integral ceramic structure as said ceramic substrate; and a plurality piezoelectric/electrostrictive elements each disposed on a portion of said closure plate opposite a corresponding pressure chamber, for deforming said portion to change a pressure within the corresponding pressure chamber, whereby the ink in the pressure chamber is jetted through corresponding one of the nozzles of said ink nozzle member, each of said piezoelectric/electrostrictive elements comprising a pair of electrodes and a piezoelectric/electrostrictive layer, which are formed by a film-forming method on an outer surface of said closure plate of said ceramic substrate, such that said piezoelectric/electrostrictive element is interposed between said pair of electrodes.

14. An ink jet print head as defined in claim 13, wherein an outer surface of said connecting plate to which said ink nozzle member is bonded has a maximum waviness of not greater than 50 μm as measured along a reference length of the 8 mm.

15. An ink jet print head as defined in claim 13, wherein said ink nozzle member consists of a nozzle plate having said plurality of nozzles, a channel plate having a window formed therethrough, and an orifice plate having a plurality of orifices, said connecting plate of said actuator being superposed on said orifice plate, said window being closed by said nozzle plate and said orifice plate so as to form an ink supply channel through which the ink flows into said plurality of pressure chambers via the respective orifices, said connecting plate further having a plurality of second communication holes for permitting fluid communication between the corresponding orifices and plurality of pressure chambers.

* * * * *